US010420413B1

(12) United States Patent
Klymenko

(10) Patent No.: US 10,420,413 B1
(45) Date of Patent: Sep. 24, 2019

(54) BAG FOR A RIFLE FOR QUICK DRAWING

(71) Applicant: Mykola Klymenko, Dniper (UA)

(72) Inventor: Mykola Klymenko, Dniper (UA)

( * ) Notice: Subject to any disclaimer, the term of this patent is extended or adjusted under 35 U.S.C. 154(b) by 0 days.

(21) Appl. No.: 16/104,912

(22) Filed: Aug. 19, 2018

(51) Int. Cl.
*A45F 3/06* (2006.01)
*F41C 33/04* (2006.01)
*A45F 3/00* (2006.01)

(52) U.S. Cl.
CPC ..... *A45F 3/06* (2013.01); *F41C 33/048* (2013.01); *A45F 2003/003* (2013.01)

(58) Field of Classification Search
CPC ..... A45F 3/06; A45F 2003/003; A45F 2200/0591; F41C 33/048
See application file for complete search history.

(56) References Cited

U.S. PATENT DOCUMENTS

2008/0023513 A1* 1/2008 Hadj-Chikh ..... A45C 13/02 224/645
2008/0121730 A1* 5/2008 Calkin ..... A45C 13/02 238/12
2010/0025446 A1* 2/2010 Eberle ..... A45F 3/04 224/652
2011/0204114 A1* 8/2011 Miller ..... A45F 3/04 224/582
2013/0086772 A1* 4/2013 Raymond ..... A44B 99/00 24/3.4
2016/0278506 A1* 9/2016 Amago ..... A45F 3/04
2017/0196343 A1* 7/2017 Dieguez ..... A45F 3/04
2018/0055199 A1* 3/2018 Eberle ..... A45F 3/06
2018/0110318 A1* 4/2018 Ackerman ..... A45F 3/04

FOREIGN PATENT DOCUMENTS

DE 102012017793 A1 * 3/2014 ..... A45F 3/06

* cited by examiner

*Primary Examiner* — Corey N Skurdal

(57) ABSTRACT

A bag for carrying a rifle that enables the user to secure the stock at specific location inside the bag. The bag includes a front wall with PALS grids, a back wall with a hook-and-loop pad, a front attachment means that is designed to be connected and adjusted to the PALS grid and a back attachment means that is designed to be connected and adjusted to the pad. The user connects and adjusts the front and the back attachment means at preferable locations inside the bag, places the rifle inside the bag and secure the stock by the front and the back attachment means in a way that the stock is positioned at the same place relative to the bag and by that enables the user to draw the rifle without necessity of eye contact with the bag.

1 Claim, 8 Drawing Sheets

BAG FOR A RIFLE FOR QUICK DRAWING

TECHNICAL FIELD

The present invention relates to a bag for undercover carrying of a rifle that is designed to enable the user to draw the rifle from the bag quickly and without necessity of eye contact with the bag.

BACKGROUND ART

Official security forces need sometimes to use armed undercover security officers or policemen amongst crowd and in public area. When such officer or policemen (hereinafter "a user") needs to carry a rifle there is a need for a bag that is designed in a way that the rifle will not be noticeable. Also important, is to enable the user to draw the rifle quickly without necessity of eye contact with the bag. Thus, the user will not lose the eye contact with the target in time of emergency when the target constitutes an immediate threat and there is a need to shoot the target immediately. The present invention aims to provide effective and efficient solutions for these problems.

LIST OF DRAWINGS

The intention of the drawings attached to the application is not to limit the scope of the invention and its application. The drawings are intended only to illustrate the invention and they constitute only one of its many possible implementations.

THE INVENTION

Figure 1:
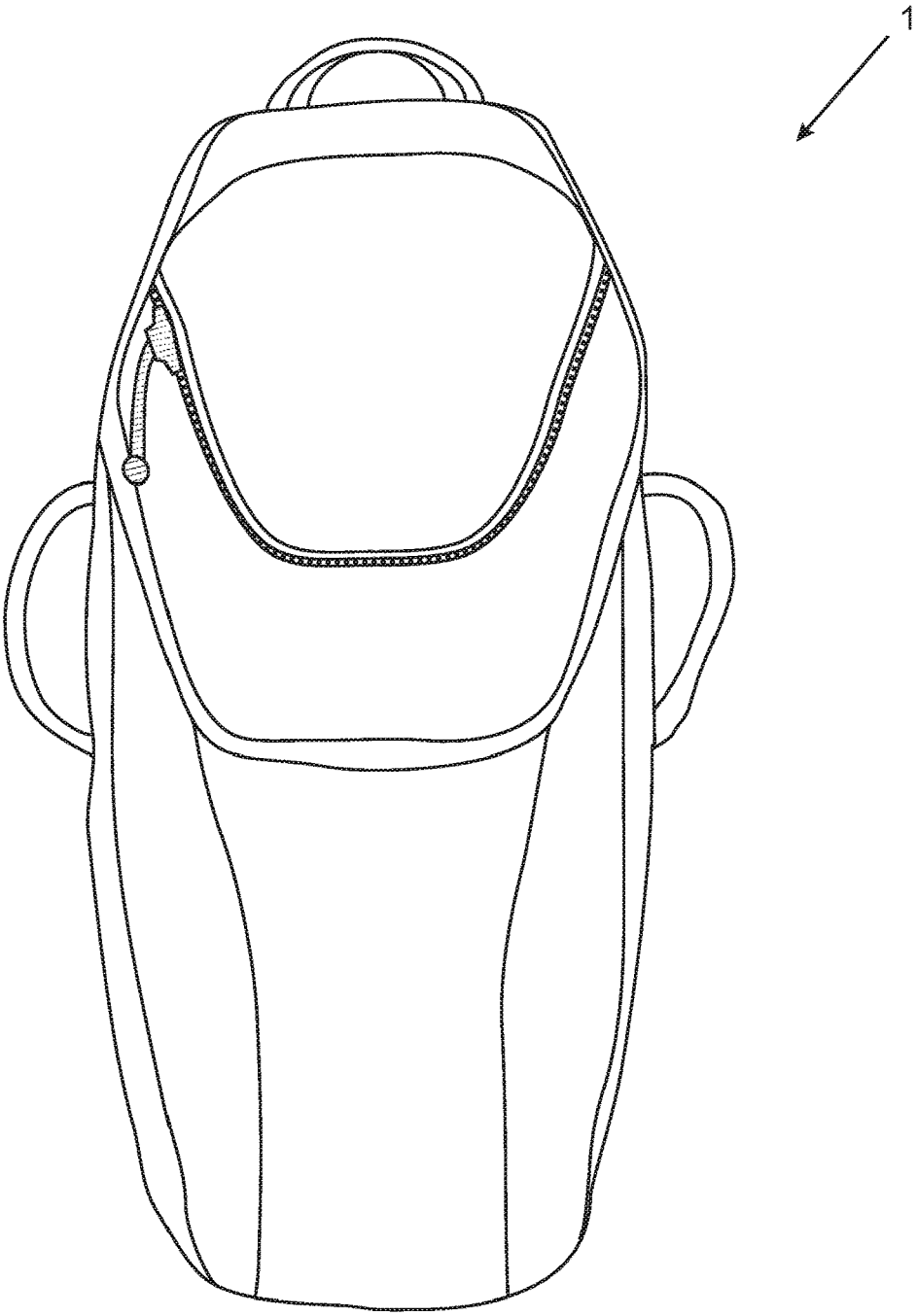
FIG. 1 depicts the bag (1) in a closed state.

The main object of the present invention is to provide a bag (1) for undercover carrying of a rifle (500) that is designed to enable the user to draw the rifle from the bag without necessity of eye contact with the bag. The bag (1) may have any kind of shape as of standard bags, suitcase, briefcase, and the like. The figures accompanied with the description illustrate one example of bag out of many possible bags and the figures do not intended to limit to scope of the invention. The term "bag" in this patent application refers to any apparatus that may be used to carry things including a rifle including bags, suitcase, briefcase, and the like The bag (1) includes a front wall (100) that its inner side (101) includes PALS grids (102), a back wall (200) that its inner side (201) includes a hook-and-loop fastener pad (202), a front attachment means (10), a back attachment means (20), and a closure means (300) that is designed to attach and detach at least a circumferential part of the front wall (100) to at least a circumferential part of the back wall (200). These at least circumferential parts of the front wall (100) and the back wall (200) constitute the opening (301) of the bag through which the user can inserts the rifle inside the bag and draws out the rifle out of the bag. The term PALS is in fact an acronym for Pouch Attachment Ladder System, which is a known grid of webbing that used to attach smaller equipment onto load-bearing platforms, such as vests and backpacks.

The front attachment means (10) includes a basic strip (11) with a closure means (12) that is designed to connect the front attachment means (10) to the PALS grids (102), adjustable strip (13) and a hook-and-loop coupling piece (14). The closure means (12) that is depicted in the figures is a type of press snap button but it is possible to use other kind of closure means. The back attachment means (20) includes a pair of strips (21) that the first end (211) of each of them is designed to be connected to the hook-and-loop fastener pad (202) of the back wall (200). It is possible that the back attachment means (20) will include a basic piece (23) to which the first ends (211) of the pair of strips (21) will be connected, for example by sewing, and the back part of the piece (23) will include hook-and-loop fastener corresponding with the hook-and-loop fastener pad (202) of the back wall (200) of the bag (1). The second end (212) of each of said pair of strips (21) is ended with a hook-and-loop piece (22).

The user can connect the front attachment means (10) at any preferable location to the PALS grids (102) according the dimensions of the rifle (500) and basically according the will of the user as to the specific location that he or she would like to have the stock (501) relative to the bag. The user can also adjust the adjustable strip (13), for example by rolling part of it on the basic strip (11), to a preferable length so that the hook-and-loop coupling piece (14), which in fact is the end of the adjustable strip, will fit to the position of the hook-and-loop piece (22) when they secure the stock of the rifle (500) to a preferable position inside the bag.

The user can attach the back attachment means (20) at a preferable location to the hook-and-loop fastener pad (202), again, according the dimensions of the specific rifle that the user needs to carry and the specific location that the stock should be relative to the bag. The user can also adjust the length of each of the pair of strips (21) that may include buckles (213) that enable the user to control and determine the length of the strips (21) so they will be tighten on the stock properly. The user can place the rifle (500) inside the bag (1) and to secure the stock (501) by placing the hook-and-loop pieces (22) when they are near each other and attach to these two pieces (22) the hook-and-loop coupling piece (14). By that, the user can place the rifle inside the bag while the stock (501) is positions and tighten in the same place relative to the bag (1).

When the user is a trained person, he or she can carry the bag, and in time of emergency the user can move the bag to a specific position relative to his or her body, and then to open the bag and draw the rifle without necessity of eye contact with the bag, due to the fact that the stock of the rifle is always positioned at the same place relatively to the bag. When the user opens the bag, by forward the front wall (100) away from his or her body, then the PALS grids pull the front attachment means (10) and by that the hook-and-loop coupling piece (14) is detached from the two hook-and-loop pieces (22) and the stock is free to be drawn with his or her second hand. The fact that the stock (501) is secured to the same place inside the bag (1) and cannot move relative to the bag disable the stock (501) of the rifle to disturb a quick opening of the bag. In use, the barrel can be inserted inside an inner pocket inside the bag for better stabilization of the rifle inside the bag.

Figure 2:
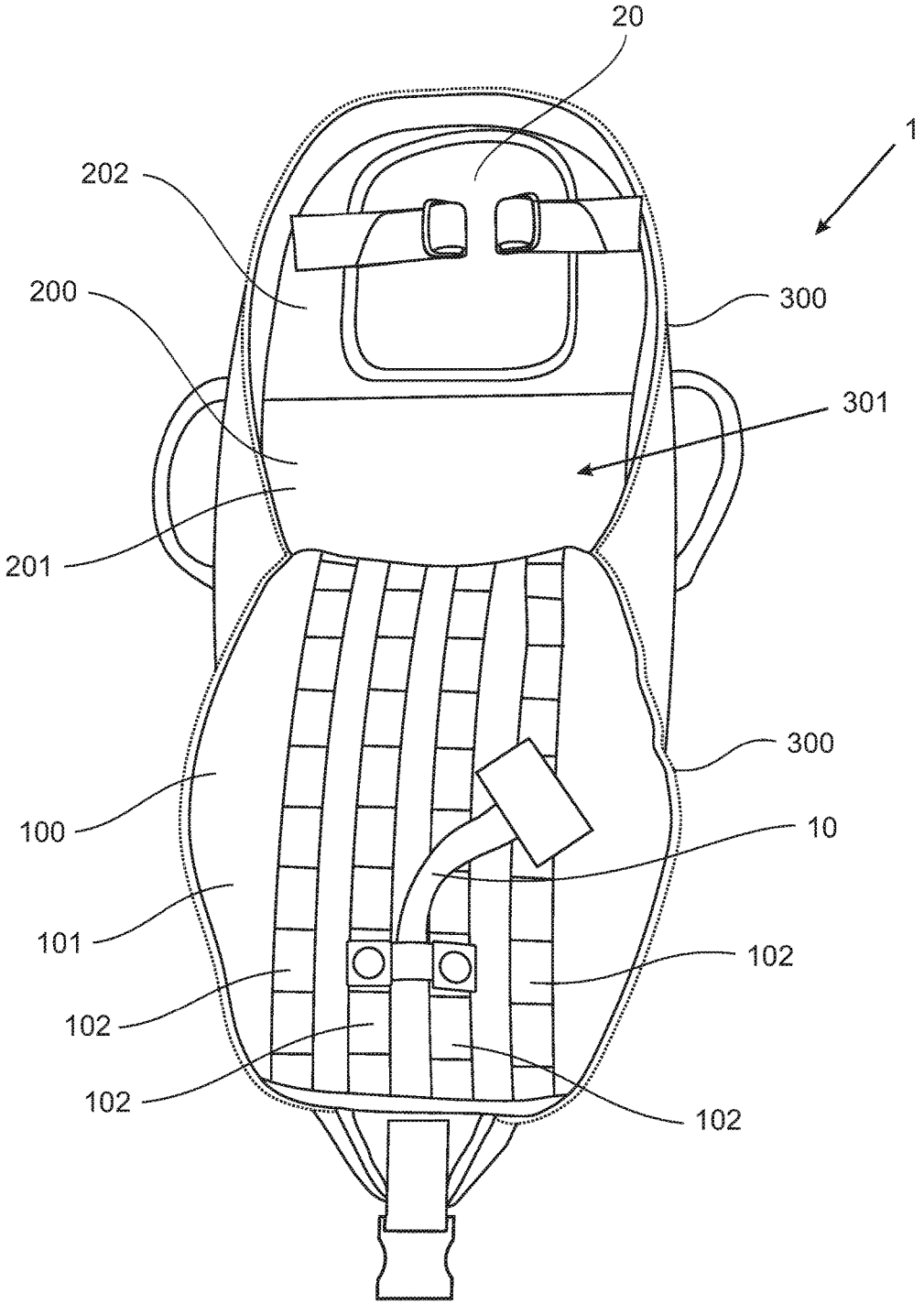
FIG. 2 depicts the bag (1) in an open state showing the inner sides (101) (201) of the front wall (100) and the back wall (200).
Figure 3:
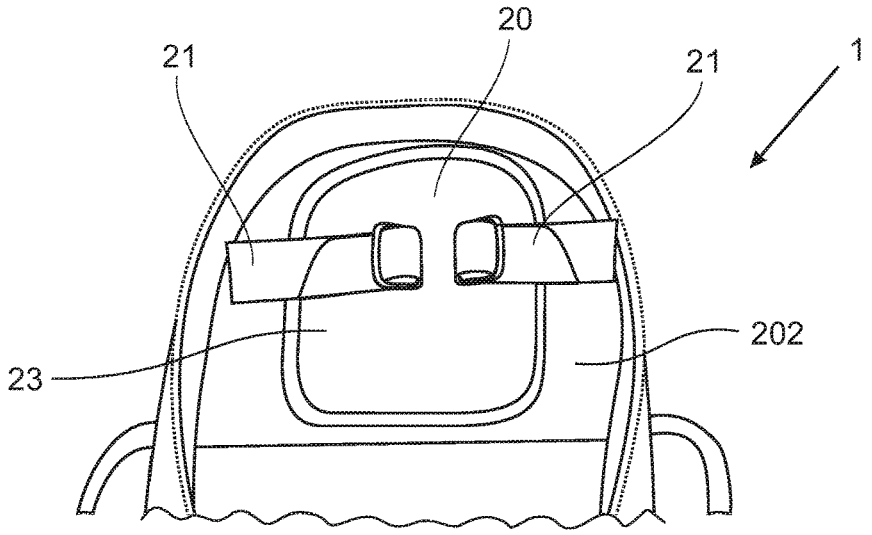
FIG. 3 depicts a part of the inner side (201) of the back wall (200), the hook-and-loop fastener pad (202) and the back attachment means (20).
Figure 4:
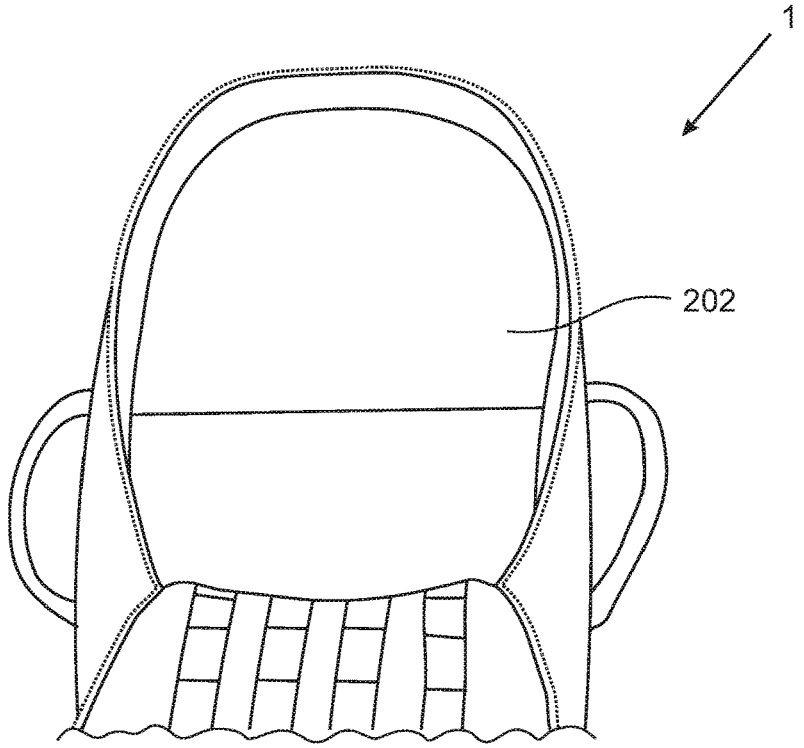
FIG. 4 depicts a part of the inner side (201) of the back wall (200), the hook-and-loop fastener pad (202) without the back attachment means (20).
Figure 5:
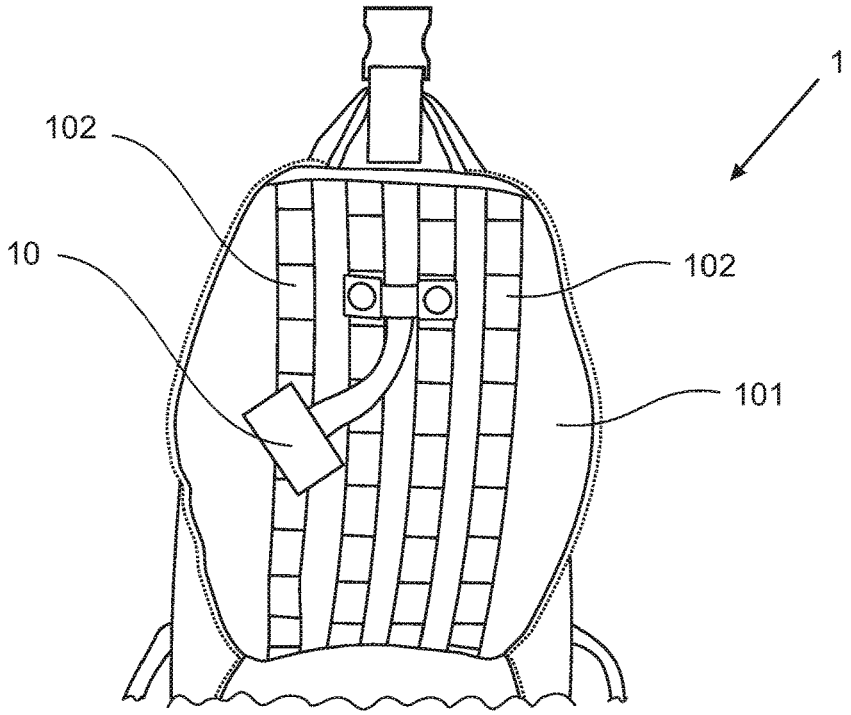
FIG. 5 depicts a part of the inner side (101) of the front wall (100), the PALS grids (102) and the front attachment means (10).
Figure 6:
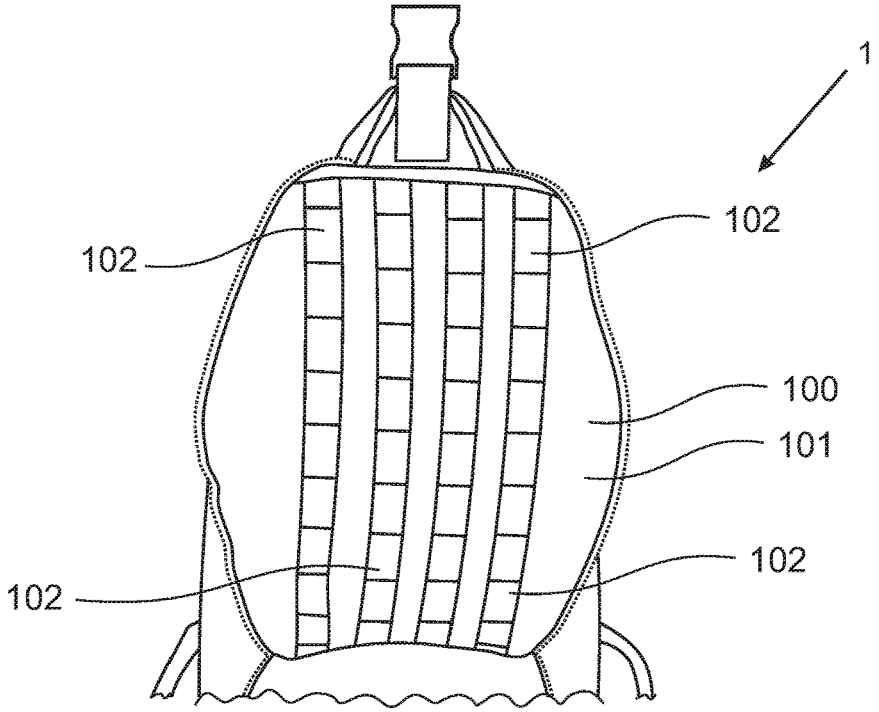
FIG. 6 depicts a part of the inner side (101) of the front wall (100), the PALS grids (102) without the front attachment means (10).
Figure 7:
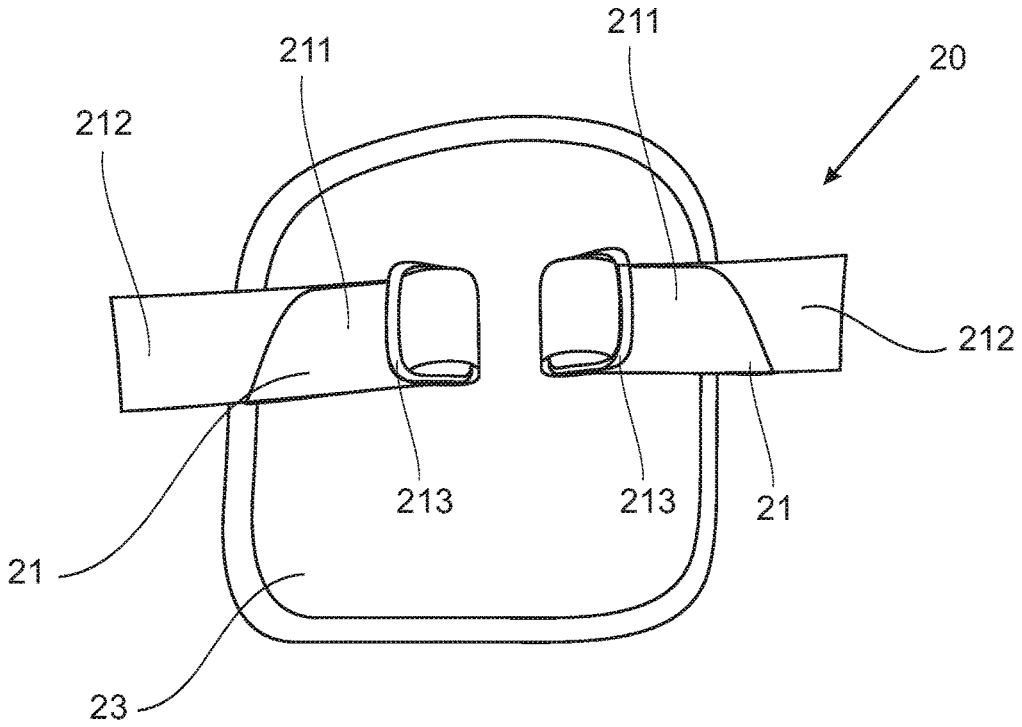
FIGS. 7 and 8 depict the back attachment means (20).
Figure 8:
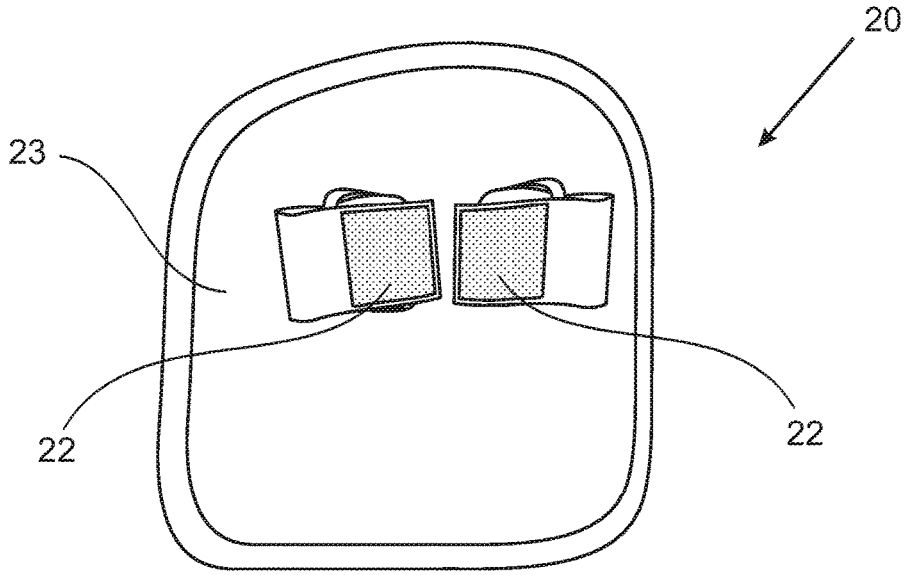
Figure 9:
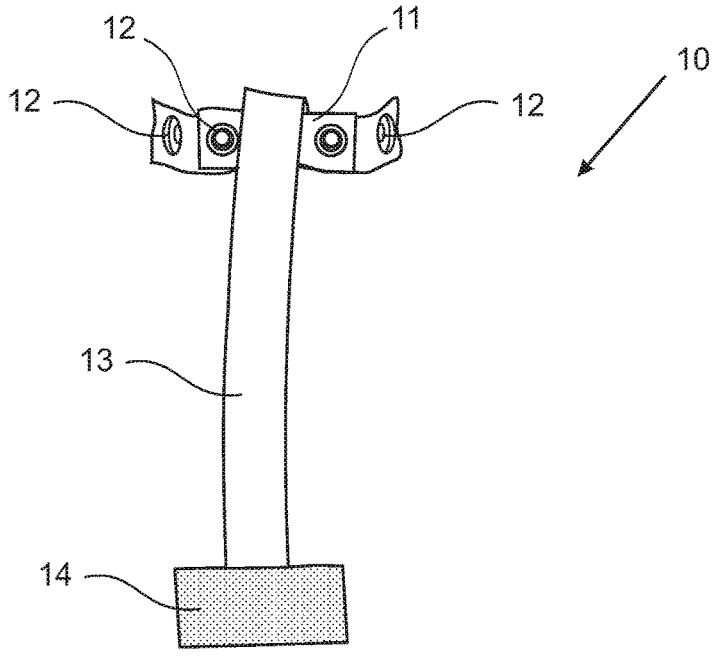
FIG. 9 depicts the front attachment means (10).
Figure 10:
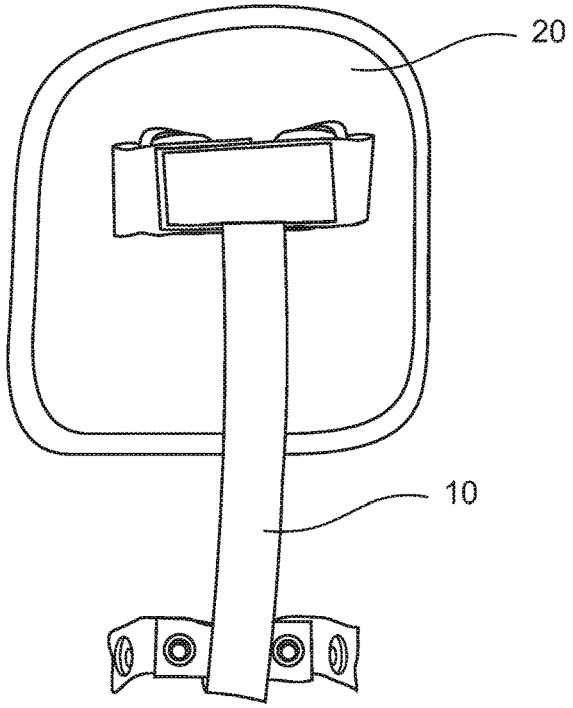
FIG. 10 depicts the back attachment means (20) attached for illustration with the front attachment means (10).
Figure 11:
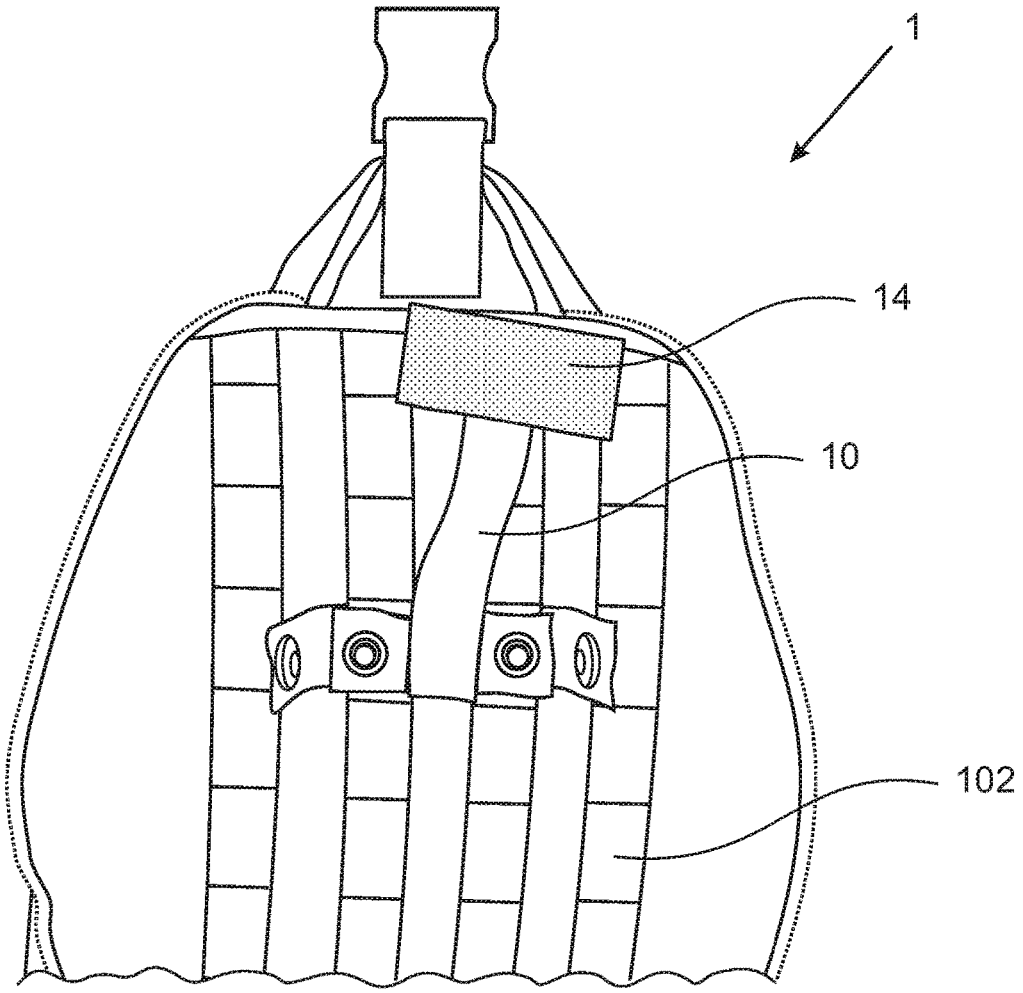
FIG. 11 depicts a part of the inner side (101) of the front wall (100), the PALS grids (102) and the front attachment means (10).
Figure 12:
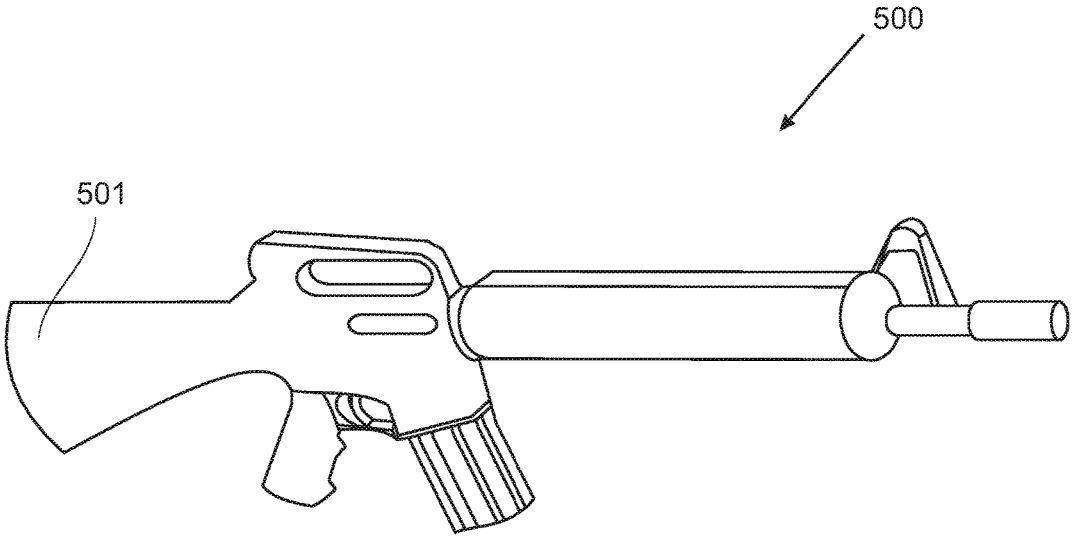
FIG. 12 depicts for illustration a rifle (500), the AR-15 which a popular model used by the US police forces.

FIG. 1 depicts the bag (1) in a closed state. FIG. 2 depicts the bag (1) in an open state showing the inner sides (101) (201) of the front wall (100) and the back wall (200). FIG. 3 depicts a part of the inner side (201) of the back wall (200), the hook-and-loop fastener pad (202) and the back attachment means (20). FIG. 4 depicts a part of the inner side (201) of the back wall (200), the hook-and-loop fastener pad (202) without the back attachment means (20). FIG. 5 depicts a part of the inner side (101) of the front wall (100), the PALS grids (102) and the front attachment means (10). FIG. 6 depicts a part of the inner side (101) of the front wall (100), the PALS grids (102) without the front attachment means (10). FIGS. 7 and 8 depict the back attachment means (20). FIG. 9 depicts the front attachment means (10). FIG. 10 depicts the back attachment means (20) attached for illustration with the front attachment means (10). FIG. 11 depicts a part of the inner side (101) of the front wall (100), the PALS grids (102) and the front attachment means (10). FIG. 12 depicts for illustration a rifle (500), the AR-15 which a popular model used by the US police forces.

What is claimed is:

1. A bag for carrying a rifle that is designed to enable a user to position and secure a stock of the rifle inside the bag at a specific location relative to the bag, comprising: a front wall that its inner side includes PALS grids, a back wall that its inner side includes a hook-and-loop fastener pad, a front attachment means, a back attachment means, and a closure means that is designed to attach and detach at least circumferential part of said front wall to a circumferential part of said back wall wherein said at least circumferential part of said front wall and said at least circumferential part of said back wall constitute an opening of said bag;

wherein said front attachment means includes a basic strip with closure means that is designed to connect said front attachment means to the PALS grids, an adjustable strip and a hook-and-loop coupling piece;

wherein said back attachment means includes a pair of strips wherein a first end of each of said pair of strips is designed to be connected to a hook-and-loop fastener pad of the back wall and wherein a second end of each of said pair of strips includes a hook-and-loop piece;

whereby enabling a user to connect said front attachment means at a preferable location to said PALS grid and to adjust the adjustable strip to a preferable length; whereby enabling a user to connect said back attachment means at a preferable location to the hook-and-loop fastener pad; and whereby enabling a user to place the rifle inside the bag in a way that the stock of the rifle is positioned at the same place relative to the bag whereby enabling the user to draw the rifle from the bag without necessity of eye contact with the bag.

* * * * *